United States Patent [19]

Hirano et al.

[11] Patent Number: 4,957,032

[45] Date of Patent: Sep. 18, 1990

[54] APPARATUS FOR REALIZING VARIABLE KEY SCALING IN ELECTRONIC MUSICAL INSTRUMENT

[75] Inventors: Katsuhiko Hirano; Masahiko Koike; Hiroyuki Toda, all of Hamamatsu, Japan

[73] Assignee: Yamaha Corporation, Hamamatsu, Japan

[21] Appl. No.: 124,915

[22] Filed: Nov. 24, 1987

[51] Int. Cl.[5] ..... G10H 7/00; G10H 5/00

[52] U.S. Cl. ..... 84/622; 84/615; 84/619; 84/626; 84/647; 84/659

[58] Field of Search ..... 84/1.01, 445, 477 R, 84/478, 1.19, 1.27, 1.28, 1.03, 1.22, 609, 615, 619, 622, 624–626, 628, 629, 633, 647, 649, 653, 657, 659

[56] References Cited

U.S. PATENT DOCUMENTS

| | | | |
|---|---|---|---|
| 4,176,573 | 12/1979 | Deutsch | 84/1.01 |
| 4,352,311 | 10/1982 | Luce et al. | 84/477 R |
| 4,358,980 | 11/1982 | Imamura | 84/477 R |
| 4,419,916 | 12/1983 | Aoki | 84/1.01 |
| 4,440,057 | 4/1984 | Ishibashi | 84/1.01 |
| 4,566,364 | 1/1986 | Katoh | 84/627 X |
| 4,664,010 | 5/1987 | Sestero | 84/1.01 |
| 4,679,480 | 7/1987 | Suzuki | 84/622 X |
| 4,706,537 | 11/1987 | Oguri | 84/622 X |
| 4,724,736 | 2/1988 | Isozaki | 84/1.01 |
| 4,794,838 | 1/1989 | Corrigau, III | 84/1.27 X |
| 4,833,962 | 5/1989 | Mazzola et al. | 84/1.01 |
| 4,890,527 | 1/1990 | Suzuki et al. | 84/660 X |
| 4,893,538 | 1/1990 | Masaki et al. | 84/622 X |
| 4,909,121 | 3/1990 | Usa et al. | 84/622 X |

FOREIGN PATENT DOCUMENTS 58-211786 12/1983 Japan .

*Primary Examiner*—A. T. Grimley
*Assistant Examiner*—Matthew S. Smith
*Attorney, Agent, or Firm*—Spensley Horn Jubas & Lubitz

[57] ABSTRACT

The key scaling apparatus for an electronic musical instrument having a keyboard includes a memory unit having plural memory areas associated respectively with plural notes or note groups represented by plural keys or key groups of the keyboard; manipulator knobs for producing desired musical tone preparing instruction signals determining the characteristics of the musical tone to be produced; registering means for writing, in those memory areas corresponding to a desired note or note group designated by an operated key, the instruction signals produced by the manipulated knobs; and control means for controlling, when a performance mode is designated, the musical tone to be produced bearing the characteristics as designated by the instruction signals read out from the related memory areas upon operation of a key. This apparatus allows the user to arbitrarily set a desired key scaling characteristic curve, and to alter the preset curves by mere manipulation of knobs, wherein easily realizing musical performances on the electronic musical instrument which are close to those produced by natural musical instruments.

10 Claims, 7 Drawing Sheets

KSC NORMAL MODE

16

| | | | | | |
|---|---|---|---|---|---|
| KSC | LD | RD | LC | RC | BP |
| NML | 45 | 23 | +L | -E | $C^{\#}_4$ |

CS

FIG. 2A

KSC FRACTIONAL MODE

16

| | | | | | | |
|---|---|---|---|---|---|---|
| KSC | $C^{\#}_3$ | → | $E_3$ | → | $G_3$ | → |
| FRC | 128 | | 145 | | 76 | |

CS

FIG. 2B

TRANSPOSE MODE

16

| |
|---|
| TRANSPOSE<br>-12 |

FIG. 2C

| KEY NAME | KEY CODE VALUE | KEY GROUP NO. |
|---|---|---|
| $C^{\#}_{-2}$ ~ $C_{-1}$ | 1 ~ 12 | 0 |
| $C^{\#}_{-1}$ ~ $D^{\#}_{-1}$ | 13 ~ 15 | 1 |
| $E_{-1}$ ~ $F^{\#}_{-1}$ | 16 ~ 18 | 2 |
| $G_{-1}$ ~ $A_{-1}$ | 19 ~ 21 | 3 |
| $A^{\#}_{-1}$ ~ $C_0$ | 22 ~ 24 | 4 |
| $C^{\#}_0$ ~ $D^{\#}_0$ | 25 ~ 27 | 5 |
| $E_0$ ~ $F^{\#}_0$ | 28 ~ 30 | 6 |
| $G_0$ ~ $A_0$ | 31 ~ 33 | 7 |
| $A^{\#}_0$ ~ $C_1$ | 34 ~ 36 | 8 |
| $C^{\#}_1$ ~ $D^{\#}_1$ | 37 ~ 39 | 9 |
| $E_1$ ~ $F^{\#}_1$ | 40 ~ 42 | 10 |
| $G_1$ ~ $A_1$ | 43 ~ 45 | 11 |
| $A^{\#}_1$ ~ $C_2$ | 46 ~ 48 | 12 |
| $C^{\#}_2$ ~ $D^{\#}_2$ | 49 ~ 51 | 13 |
| $E_2$ ~ $F^{\#}_2$ | 52 ~ 54 | 14 |
| $G_2$ ~ $A_2$ | 55 ~ 57 | 15 |
| $A^{\#}_2$ ~ $C_3$ | 58 ~ 60 | 16 |
| $C^{\#}_3$ ~ $D^{\#}_3$ | 61 ~ 63 | 17 |
| $E_3$ ~ $F^{\#}_3$ | 64 ~ 66 | 18 |
| $G_3$ ~ $A_3$ | 67 ~ 69 | 19 |

| KEY NAME | KEY CODE VALUE | KEY GROUP NO. |
|---|---|---|
| $A^{\#}_3$ ~ $C_4$ | 70 ~ 72 | 20 |
| $C^{\#}_4$ ~ $D^{\#}_4$ | 73 ~ 75 | 21 |
| $E_4$ ~ $F^{\#}_4$ | 76 ~ 78 | 22 |
| $G_4$ ~ $A_4$ | 79 ~ 81 | 23 |
| $A^{\#}_4$ ~ $C_5$ | 82 ~ 84 | 24 |
| $C^{\#}_5$ ~ $D^{\#}_5$ | 85 ~ 87 | 25 |
| $E_5$ ~ $F^{\#}_5$ | 88 ~ 90 | 26 |
| $G_5$ ~ $A_5$ | 91 ~ 93 | 27 |
| $A^{\#}_5$ ~ $C_6$ | 94 ~ 96 | 28 |
| $C^{\#}_6$ ~ $D^{\#}_6$ | 97 ~ 99 | 29 |
| $E_6$ ~ $F^{\#}_6$ | 100 ~ 102 | 30 |
| $G_6$ ~ $A_6$ | 103 ~ 105 | 31 |
| $A^{\#}_6$ ~ $C_7$ | 106 ~ 108 | 32 |
| $C^{\#}_7$ ~ $D^{\#}_7$ | 109 ~ 111 | 33 |
| $E_7$ ~ $F^{\#}_7$ | 112 ~ 114 | 34 |
| $G_7$ ~ $A_7$ | 115 ~ 117 | 35 |
| $A^{\#}_7$ ~ $C_8$ | 118 ~ 120 | 36 |
| $C^{\#}_8$ ~ $D^{\#}_8$ | 121 ~ 123 | 37 |
| $E_8$ ~ $F^{\#}_8$ | 124 ~ 126 | 38 |
| $G_8$ | 127 | 39 |

FIG. 3

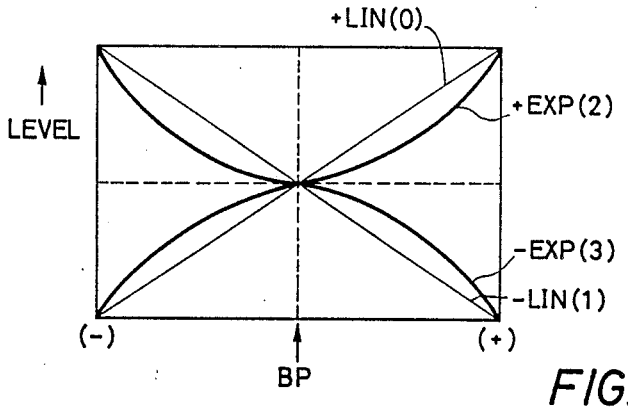

FIG. 4

APPARATUS FOR REALIZING VARIABLE KEY SCALING IN ELECTRONIC MUSICAL INSTRUMENT

BACKGROUND OF THE INVENTION (a) Field of the Invention

The present invention relates to a key scaling apparatus for use in an electronic musical instrument to control such musical tone characteristics as tone volume, tone color and tone pitch for every note and for every note group constituted with the keys of the keyboard of the electronic musical instrument. More particularly, the present invention concerns an apparatus mentioned above for allowing the player of an electronic musical instrument equipped with this apparatus to realize an intended or desired key scaling to produce musical tones closely resembling the tones of a natural musical instrument.

(b) Description of the Prior Art

In the past, there has been known a key scaling apparatus for an electronic musical instrument, which is so designed that, from among preset limited fixed kinds of key scaling curves, an arbitrary one is selected by the player of the instrument to control the musical tones which are to be sounded out (for example, see Japanese Patent Preliminary Publication No. Sho 58-211786).

According to this known apparatus mentioned above, the player cannot but rely upon only several preset stereotyped key scaling curves (e.g. straightforward curves, exponential curves, etc.), so that they are not sufficient from the aspect of richness of expression of performance. More specifically, in the case of natural musical instruments such as guitar or piano for example, the produced tone quality differs with each string of the instrument. However, it has been practically impossible with the prior art key scaling apparatuses to adroitly express, by utilizing only those preset typical key scaling curves, subtle and delicate difference in the quality of respective musical tones which are sounded out. In order to solve this difficulty, key scaling curves for every kind of musical instrument may be provided. This, however, will lead to an enormous amount of tone control data which are to be stored in a memory, thus resulting in the inconvenience that a memory of a tremendously large capacity is required.

SUMMARY OF THE INVENTION

It is, therefore, a primary object of the present invention to provide a key scaling apparatus for use in an electronic musical instrument, which makes it possible to realize key scaling curves abundant in variety of performance expression by the use of a memory of a small capacity.

The above and other objects, features and advantages of the present invention will become more apparent from the following detailed description when taken in conjunction with the accompanying drawings in which a preferred embodiment of the present invention is shown by way of illustrative example.

BRIEF DESCRIPTION OF THE DRAWINGS

FIGS. 2A, 2B and 2C are illustrations showing examples of indications in each of various different operating modes.

FIG. 3 is an illustration showing the contents of memory of the key code-key group conversion table KGCNV.

FIG. 4 is a graph showing various different key scaling curves which can be selected from both functional tables LINTBL and EXPTBL.

DETAILED DESCRIPTION OF THE PREFERRED EMBODIMENT

Figure 1:
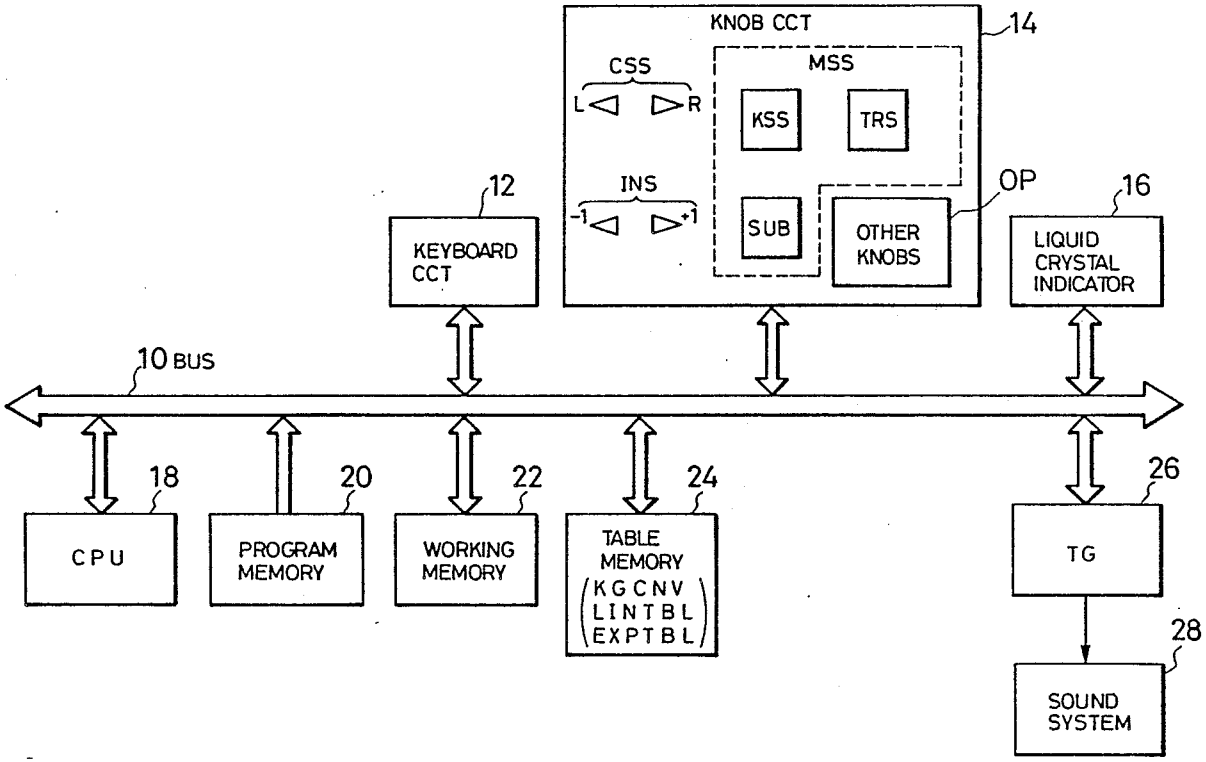
FIGS. 1 is a block diagram showing the circuit arrangement of an electronic musical instrument equipped with the key scaling apparatus representing an embodiment of the present invention.

FIG. 1 shows the circuit arrangement of an electronic musical instrument equipped with the key scaling apparatus according to an embodiment of the present invention.

This electronic musical instrument is arranged to be operative so that such items as the setting of key scaling characteristics, the setting of the amount to be transposed (hereinafter to be referred to as "transpose amount" for the sake of simplicity), the generation of musical tones, and like operations (behavior) are controlled by a micro-computer.

Circuit arrangement (FIG. 1)

To a bus 10 are connected a keyboard circuit 12, a manipulator knob circuit 14, a liquid crystal indicator 16, a central processing unit (CPU) 18, a program memory 20, a working memory 22, a table memory 24 and a tone generator (TG) 26.

The keyboard circuit 12 includes a keyboard having, as an example, sixty-one (61) keys representing as many notes $C_1 \sim C_6$, respectively, and is so arranged for each of the keys that, whenever a key operation is performed, the key operation signal, i.e. the signal of the musical note corresponding to this operated key, is detected.

The manipulator knob circuit 14 includes cursor-mover switches CSS, input switches INS, mode designating switches MSS and other manipulator knobs OP. As the cursor-mover switches CSS, there are provided a rightward movement switch R and a leftward movement switch L. As the input switches INS, there are provided a decrement switch "−1" and an increment switch "+1". As the operating mode designating switches MSS, there are provided a key scaling mode selecting switch SUB and a transpose mode selecting switch TRS. Arrangement is provided so that, in the manipulator knob circuit 14, the detection of any knob manipulation signal can be made for every switch, i.e. for every manipulator switch or knob.

The liquid crystal indicator 16 is intended to display the amount of setting, etc. for each operation mode. With respect to the selection of the modes and also to the examples of their display, description will be made later by referring to FIG. 2.

The CPU 18 is intended to carry out various kinds of processing for such items as the setting of key scaling characteristics, the setting of the transpose amount, the generation of musical tones, and like operations in accordance with the operation program stored in the program memory 20. With respect to these kinds of processing, description will be made later by referring to FIGS. 5~9.

The working memory 22 includes a number of memory areas which are utilized to serve as the registers and like devices at the time various kinds of processing are carried out by the CPU 18. With respect to those registers and the like which are related to the practicing of the present invention, description will be made later.

The table memory 24 includes a key code/key group conversion table KGCNV, a first functional table LINTBL for storing rectilinear key scaling curves and a second functional table EXPTBL for storing exponential key scaling curves. With respect to the contents of memory of these tables, description will be made later by referring to FIGS. 3 and 4.

The tone generator TG 26 is intended to form and deliver out musical tone signals based on the key operations performed on the keyboard and under the control by the CPU 18. The musical tone signals which are supplied to a sound system 28 are converted to audible sounds.

Mode selection and examples of display (FIG. 2)

Upon turning-on the switch KSS, a key scaling mode is selected. When this mode is selected, it should be understood that each time the sub-mode switch SUB is turned on, the normal mode for KSC (key scaling) and the fractional mode for KSC are selected in an alternate fashion.

When the KSC normal mode has been selected, it is possible to select the data of a desired key scaling curve from the contents of the table memory 24, or to alter the gradient of the selected key scaling curve. And, on the screen of the indicator 16, there is made such a display as is shown by way of example in FIG. 2A. That is, in FIG. 2A, "KSCNML" is indicative of "KSC normal mode", whereas "LD", "RD", "LC⇄, "RC" and "BP" represent the parameters for determining the desired key scaling curves, respectively. More particularly, "BP" is the sign indicating the "break point", while "RC" represents the curve which lies on the righthand side of the break point; "LC" indicates the curve positioned on the lefthand side of the break point; "RD" is indicative of the depth (depth of the level) on the righthand side of the break point; and "LD" is indicative of the depth on the lefthand side of the break point. The numerical values or symbols which are given below these respective signs are intended to represent the contents of the data of the corresponding respective parameters. The details of these parameters will be described later by referring to FIG. 4.

By operating the cursor-mover switches CSS, the position of the cursor CS is moved, whereby the indication of an arbitrary parameter such as "RD" can be realized. With respect to the specific parameter thus indicated by the cursor CS, the content thereof can be set appropriately by the manipulation of the concerned input switches INS.

When the KSC fractional mode is selected, it is possible to appropriately set the individual level values for the selected key scaling curves. Thus, on the indicator 16, there is made such a display as mentioned exemplarily in FIG. 2B. In this FIG. 2B, the sign "KSCFRC" indicates "KSC Fractional Mode". And, on the righthand side thereof, there are displayed level values for three (3) groups each being sectioned to constitute an individual group for every three keys (notes). Arrangement is provided so that identification of each key group is attained by displaying the key (i.e. note) name of the lowest pitch note (key) among those notes (keys) belonging to the concerned note (key) group. In the illustrated examples, "$C\#_3$", "$E_3$" and "$G_3$" represent those key (note) groups to which the respective notes (keys) belong. In the case of "KSC Fractional Mode", arrangement is provided so that the cursor CS always points to the central note (key) group among the three (3) note (key) groups. By manipulating the cursor-mover switches CSS, those note name (key name) level value indications for three (3) note groups can be shifted either rightwardly or leftwardly. With respect to the central key (note) group which is pointed at by the cursor CS, the user is allowed to appropriately set the level value by the manipulation of the input switches INS.

By turning the switch TRS on, the Transpose Mode is selected. When this mode is selected, pronunciation of tone is feasible in the state that the note of the key depressed on the keyboard is transposed. On the indicator 16, there is made a display as shown exemplarily in FIG. 2C. In FIG. 2C, the symbol "TRANSPOSE" is indicative of the "TRANSPOSE MODE", and below thereof, the amount to be transposed, such as "−12", is displayed. It should be noted here that the amount "−12" which is to be transposed signifies that the note pitch of the depressed key is to be lowered by one (1) octave.

In case neither one of the switches KSS and TRS is turned on, this signifies the "NORMAL PERFORMANCE MODE", and tones corresponding to the notes of those keys depressed on the keyboard are pronounced.

Contents of memory of the conversion table KGCNV (FIG. 3)

FIG. 3 exemplarily shows the contents of memory of the key code/key group conversion table KGCNV. This table KGCNV stores the note (key) group data for forty (40) note (key) groups representing note (key) group numbers "0"~"39", respectively.

As stated above, the keyboard has sixty-one (61) keys for notes $C_1 \sim C_6$. In this instant embodiment, however, it should be noted that, because of the provision of the "Transpose Mode", the processing of notes in the range of $C\#_{-2} \sim G_8$ which is broader than the range of $C_1 \sim C_6$ is made feasible. The note names $C\#_{-2} \sim G_8$ are allotted with key code values "1"~"127", respectively. Arrangement is provided so that key code names $C\#_{-2} \sim C_{-1}$ constitute one (1) note (key) group, and to this note group is assigned a note (key) group number "0". Also, note names $C\#_{-1} \sim F\#_8$ are arranged so that one note group is constituted for every three (3) notes (keys). To those thirty-eight (38) note groups thus obtained are assigned note (key) group numbers "1", "2", . . . , "38", respectively, beginning with the lower pitch note side. And, to the remainder note name $G_8$ is assigned the note group number "39". The conversion table KGCNV is intended to convert the parallel "7"-bit key code data to parallel "6"-bit note group data. For example, the key code data for three (3) notes (keys) belonging to the note (key) group $E_3 \sim F\#_3$ are converted invariably to note (key) group data indicative of the note (key) group number "18".

Key scaling curves (FIG. 4)

FIG. 4 shows various kinds of key scaling curves which can be selected from the first functional table LINTBL and the second functional table EXPTBL. As an example, in the first functional table LINTBL are stored level data for preparing (i.e. controlling) the tone volume for every note group in accordance with a rectilinear key scaling curve "+LIN" having a positive gradient. Concurrently therewith, in the second functional table EXPTBL, level data for controlling the tone volume for every note group in accordance with the exponential key scaling curve "+EXP" having a positive gradient are stored. When level data are stored in the table LINTBL and EXPTBL in accordance with the curves "+LIN" and "+EXP", respectively, in such a manner as stated just above, it should be noted that, by reading out the data in the direction from the "plus" side toward the "minus" side of the horizontal axis of FIG. 4, it is possible to obtain level data complying with the rectilinear key scaling curve "−LIN" having a negative gradient, or level data complying with exponential key scaling curve "−EXP" having a negative gradient.

In FIG. 4, the sign "BP" represents a break point which, in turn, is made to correspond to any specific note group. At the time the KSC Normal Mode is selected, the key group (note group) corresponding to the break point BP is indicated by the note name such as $C\#_4$ of the lowest pitch note key belonging to this specific note group as shown in FIG. 2A. And, when by manipulating the cursor-mover switch CSS, the cursor CS is moved to the position of "BP", the user is now able to set an arbitrary key (note) group to serve as the break point BP by the manipulation of the input switch INS. Also, at the time the KSC Normal Mode is selected, it should be noted that, on either one of the righthand side or the lefthand side of the break point BP, it is possible to select either one of the curves "+LIN", "−LIN", "+EXP", and "−EXP". For example, in FIG. 2A, when the cursor CS is positioned at "RC", the user is able to select the curve "−EXP" by manipulating the input switch INS. When this curve is thus selected, there is displayed, on the indicator 16 below the symbol "RC", a sign "−E" representing "−EXP". Also, when the cursor CS is positioned at "LC", it is possible to select the curve "+LIN" by the manipulation of the input switch INS. When this curve is selected, "+L" which represents "+LIN" is displayed below the symbol "LC" of the indicator 16. In the same manner, when "+EXP" is selected, "+E" is displayed, while in case "−LIN" is selected, "−L" is displayed. Furthermore, at the time the KSC Normal Mode is selected, it is also possible to perform a setting in order to alter the gradient of the curve which has been selected on either the righthand side or the lefthand side of the break point BP. More specifically, in FIG. 2A, when the cursor CS is pointing at "RD", it is possible to arbitrarily set, by the manipulation of the input switch INS, the value of the depth data which is displayed below "D". The value thus set is multiplied with the individual level values which constitute the curve which could be "−EXP" if "RC"="−E", so that the gradient of the curve "−EXP" is freshly set in accordance with the result of this multiplication. On the other hand, in case the cursor CS is positioned at "LD", also, it is possible to make an operation similar to that mentioned above, and if, for example, "LC"="+L", the gradient of the curve "+LIN" is determined also in accordance with the freshly set numerical value.

Registers in the working memory

Among the registers in the working memory 22, those which are associated with the practicing of the present invention will be enumerated below.

(1) Mode register MOD

This is intended to store mode designation data. When the key scaling mode selecting switch KSS is turned on, "1" is set, whereas when the transpose mode selecting switch TRS is turned on, "2"is set. In case, however, neither one of the switch KSS and TRS is turned on, the numerical value of the register MOD remains to be "0", indicating the normal performance mode is running.

(2) Sub-mode register SUBMD

This is intended to be operative so that "0" and "1" are set alternately each time the sub-mode selecting switch SUB is turned on. If "0" is set, this indicates KSC Normal Mode, whereas when "1" is set, it is indicative of KSC Fractional Mode.

(3) Key number register KEYNO

This is intended to store the key number data corresponding to the depressed keys. The key (note) number data assumes either one of the values "0"~"60" corresponding to the notes $C_1 \sim C_6$, respectively.

(4) Key-on/off register KON/OF

This is intended to store key-on/off signals.

(5) Key code register KC

This is to store key code data. As shown in FIG. 3, the key code data assumes either one of the numerical values "1"~"127".

(6) First note (key) group register $GRP_1$

This is to store the note (key) group data read out from the conversion table KGCNV at the time of a key-on operation. The key group data assumes either one of the numerical values "0"~"39" as shown in FIG. 3.

(7) Second note (key) group register $GRP_2$

This is to store note (key) group data at the time of KSC Fractional Mode.

(8) Transpose data register TRANS

This is to store transpose data. Transpose data assumes either one of the numerical values "1"~"67". A numerical value which is obtained by subtracting "36" from the numerical value of the transpose data is the amount to be transposed which is displaced on the indicator 16. Accordingly, in case transpose value="36", the amount to be transposed is "zero", so that no transposition takes place.

(9) Break point register BRKPNT

This is intended to store the key (note) group data corresponding to a break point BP.

(10) Righthand curve register RCVSEL

This is intended to store curve identification data for the curve selected on the righthand side of the break point BP. As shown in FIG. 4, the curve identification data assumes either one of the numerical values "0", "1", "2" and "3" corresponding to "+LIN", "−LIN", "+EXP" and "−EXP", respectively.

(11) Lefthand curve register LCVSEL

This is intended to store curve identification data for the curve selected on the lefthand side of the break point BP. The numerical values assumed by the curve identification data are the same as those for the above-described righthand curve register RCVSEL.

(12) Righthand depth register RDPTH

This is intended to store depth data for the righthand side of the break point BP. The depth data assumes either one of the numerical values "0"~"99".

(13) Lefthand depth register LDPTH

This is intended to store depth data for the lefthand side of the break point BP.

(14) Key scaling registers $KEYSC_0 \sim KEYSC_{39}$

These registers are mated with the key groups numbering "0""39", respectively. In each of these registers, level data for preparing (controlling) the tone volume of its corresponding note (key) group is stored. The level data assumes one of the numerals "0"~"255".

(15) Break point distance register LEN

This is intended to store the distance data indicative of the distance between an arbitrary note group and the break point BP. The distance data assume minus values on the lefthand side of the break point BP, whereas on the righthand side of BP, the data assume plus values, and at BP, "0" is assumed.

(16) Functional table reading-out register LN

This is intended to be loaded with the distance data read out from the register LEN. In setting the above-said distance data, it should be noted that there is the instance wherein the sign of the data values is altered and the instance wherein the sign is not changed. In any case, the data of the register LN are utilized in reading out level data from the functional table LINTBL or EXPTBL.

(17) Key scaling buffer register KSCB

This is intended to temporarily store the level data read out from the functional table LINTBL or EXPTBL.

Figure 5:
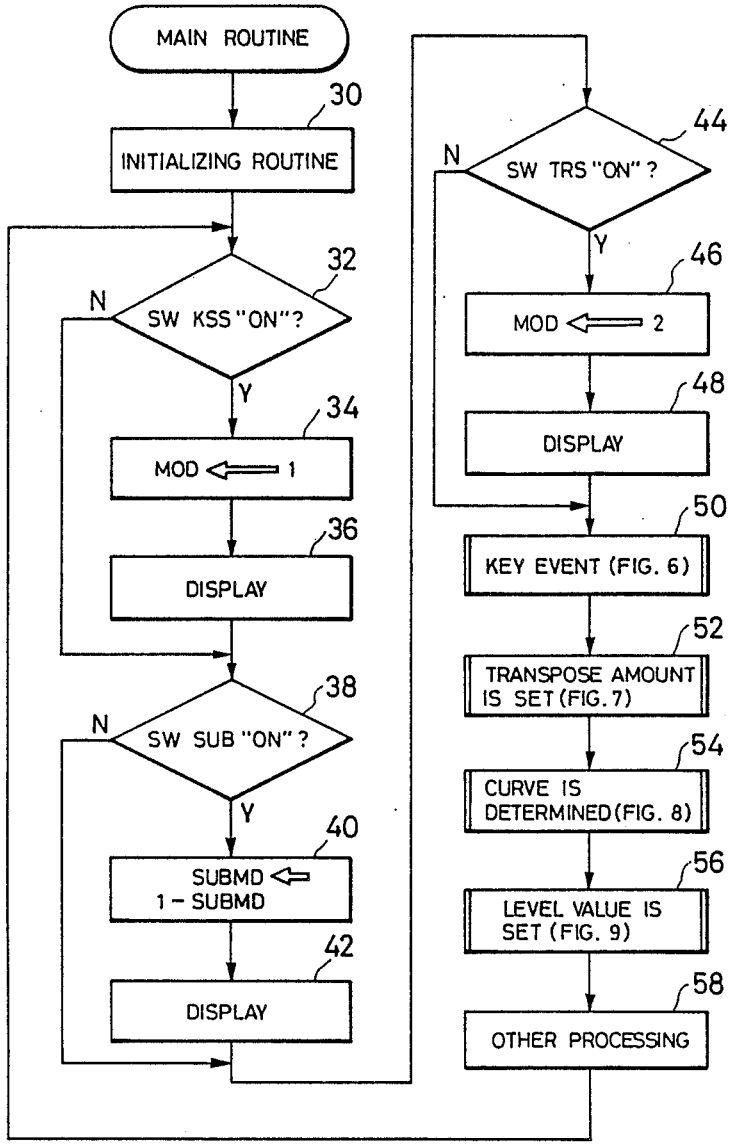
FIG. 5 is a flow chart showing the main routine.

Main routine (FIG. 5)

FIG. 5 shows the flow of the processing of the main routine. To begin with, in Step 30, it should be understood that, in accordance with such operations as the connection of the apparatus to a power supply not shown, the initializing routine is carried out, thus setting the respective initial values to the respective registers. For example, "0" is set in both of the registers MOD and SUBMD, whereas "36" (corresponding to the transpose amount "zero") is set in the register TRANS.

Next, in Step 32, judgment is made whether the switch KSS is turned on. If it is turned on, (Y), "1" is set in the register MOD in Step 34, and thereafter processing moves to Step 36, wherein indication (display) processing is carried out. In this indication processing, the indicator 16 is caused to make such a display as shown in either FIG. 2A or 2B in compliance with the numerical value of the register SUBMD. During the period immediately following the commencement of the main routine, the contents of the data having been initially set in Step 30 are displayed on the indicator 16.

When the processing in Step 36 is completed or in case the result of judgment made in Step 32 is negative, (N), processing moves to Step 38. In this Step 38, judgment is made whether the switch SUB is turned on, and if it is turned on, (Y), processing moves to Step 40.

In Step 40, a numerical value obtained by subtracting the value of the register SUBMD from "1" is set in the same register SUBMD. That is, in case the value of the register SUBMD is "1", the numeral "0" is set in the register SUBMD, whereas in case the value of the register SUBMD is "0", the numeral "1" is set in SUBMD. With this, processing moves to Step 42.

In Step 42, indication processing is carried out in a manner similar to that made in Step 36, in accordance with the numerical value of SUBMD. As a result, when the indicator 16 has been performing such a display as illustrated in FIG. 2A, this indication is altered to such a display as mentioned in FIG. 2B, whereas when the indicator has been performing a display as mentioned in FIG. 2B, this indication is altered to such a display as shown in FIG. 2A.

When the processing in Step 42 is completed or when the result of judgment in Step 38 is negative, (N), processing moves to Step 44. In this Step 44, judgment is made whether the switch TRS is turned on, and if it is "on", (Y), the numeral "2" is set in the register MOD in Step 46, and thereafter processing advances to Step 48, wherein indication processing is carried out. In this indication processing, the indicator 16 is caused to make such a display as shown in FIG. 2C. In this case, it should be noted that, as the amount to be transposed, a numerical value obtained by subtracting "36" from the numerical value of the register TRANS is displayed. In case of the time being immediately after the start of the main routine, "0" is displayed since the numerical value of TRANS is "36".

Figure 6:
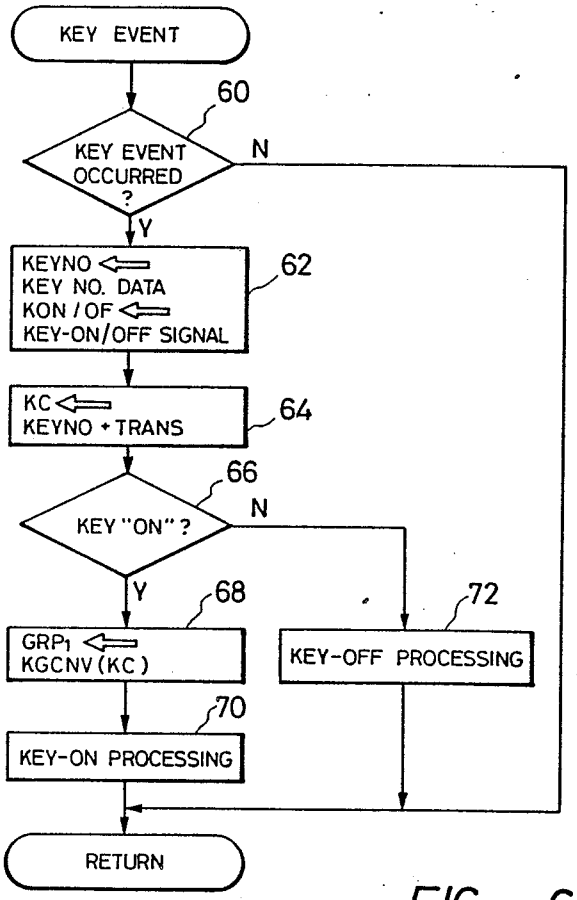
FIG. 6 a flow chart showing the key event sub-routine.

When the processing in Step 48 has ended or when the result of judgment in Step 44 is negative, (N), processing moves to Step 50, wherein such a key event sub-routine as will be described later with respect to FIG. 6 is carried out.

Figure 7:
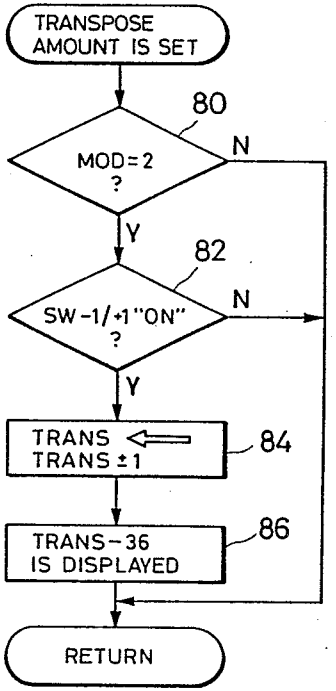
FIG. 7 is a flow chart showing the "transpose" amount setting sub-routine.

When the processing in Step 50 has completed, processing moves to Step 52, wherein such a transpose amount setting sub-routine as will be described later with respect to FIG. 7 is carried out.

Figure 8:
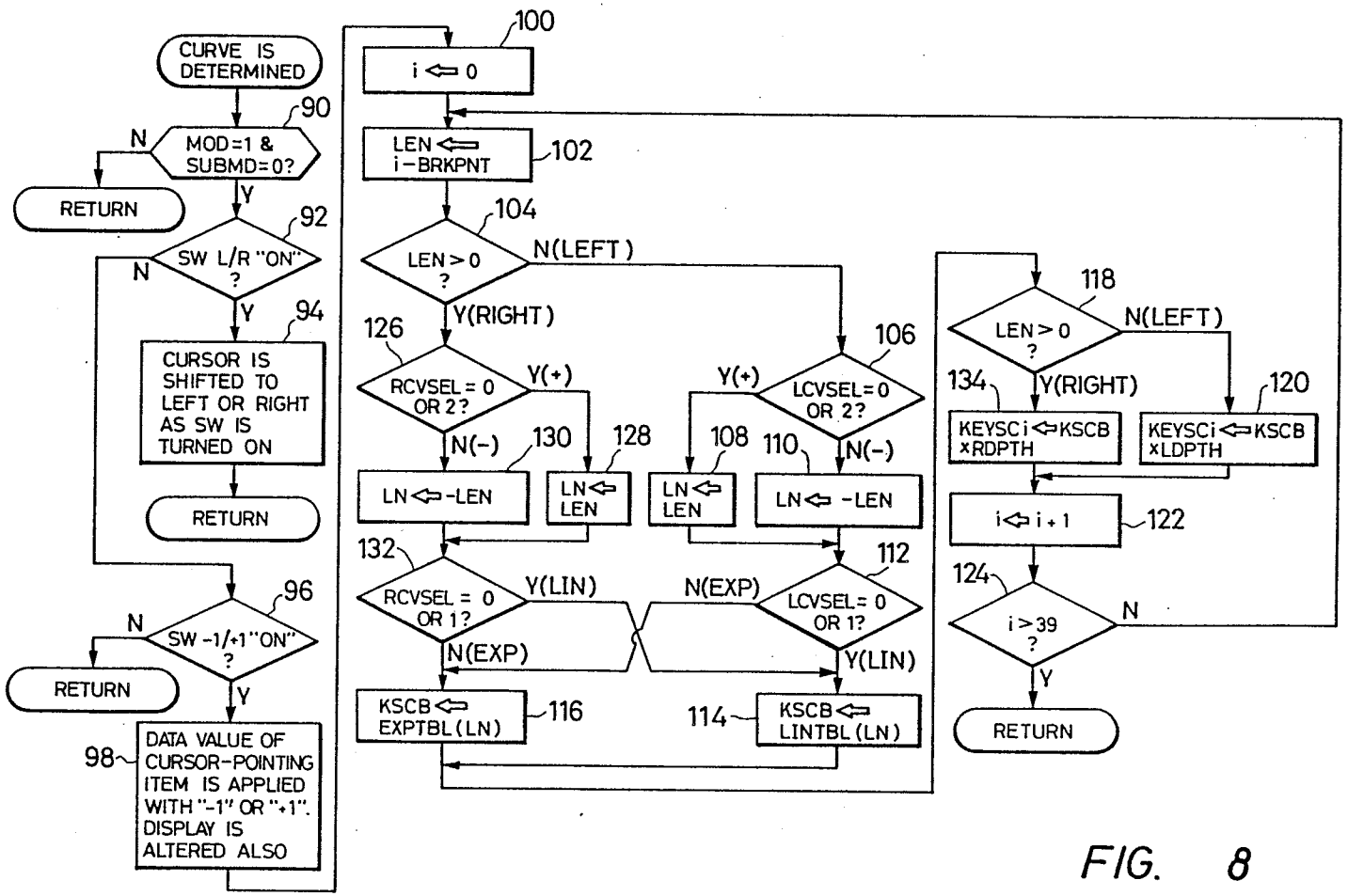
FIG. 8 is a flow chart showing the curve-determining sub-routine.

In case the processing in Step 52 has ended, processing moves onto Step 54, wherein such a curve determining sub-routine as will be described later with respect to FIG. 8 is carried out.

Figure 9:
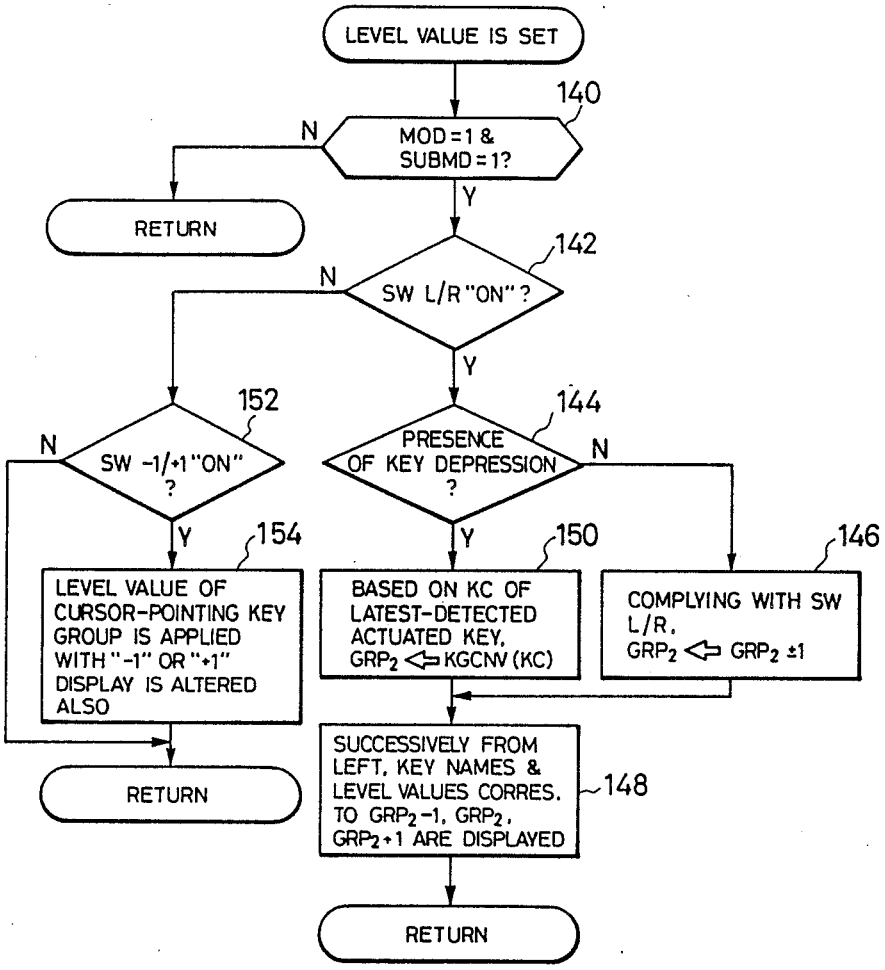
FIG. 9 is a flow chart showing the level value setting sub-routine.

When the processing in Step 54 has ended, processing moves to Step 56, wherein such a level value setting sub-routine as will be described later with respect to FIG. 9 is carried out.

When the processing in Step 56 has ended, processing moves to Step 58, wherein other kinds of processing (such as tone color setting processing) are carried out.

When the processing in Step 58 has ended, processing returns to Step 32, wherein such kinds of processing as described above are repeated.

Key event sub-routine (FIG. 6)

FIG. 6 shows the key event sub-routine. In Step 60, judgment is made whether there is a key event (key-on or key-off) on the keyboard. In case the result of this judgment is negative, (N), processing returns to the routine of FIG. 5.

If the result of judgment in Step 60 is affirmative, (Y), processing moves to Step 62. In this Step 62, the key number of the key of which a key event has taken place is stored in the register KEYNO, and along therewith a key-on or key-off signal is stored in the register KON/OF. And, processing moves to Step 64.

In Step 64, the numerical value which is obtained by adding the value of the register TRANS to the value of the register KEYNO is set in the register KC. This processing enables a transposition.

Next, in Step 66, judgment is made whether there is a key-on event, by referring to the register KON/OF. If the result of this judgment is affirmative, (Y), processing moves to Step 68.

In Step 68, a key (note) group number corresponding to the key code of the register KC is read out from the conversion table KGCNV, and it is set in the register $GRP_1$. With this, processing moves to Step 70.

In Step 70, a key-on processing is carried out. That is, the key code of the register KC, the key-on signal of the register KON/OF and the level data of the register KEYSC corresponding to the key group number of the register $GRP_1$ are delivered out to the tone generator TG 26, to cause the latter to start the pronunciation of the musical tone corresponding to said key code with a tone volume complying with said level data. Thereafter, processing returns to the routine of FIG. 5.

In case the result of judgment in Step 66 is negative, (N), processing moves to Step 72, wherein a key-off processing is carried out. More particularly, the key code of the register KC and the key-off signal of the register KON/OF are delivered out to the tone generator TG 26, to cause the latter to suspend the pronunciation of the musical tone corresponding to said key code. Thereafter, processing returns to the routine of FIG. 5.

Transpose amount setting sub-routine (FIG. 7)

FIG. 7 shows the transpose amount setting sub-routine. In Step 80, judgment is made whether the value of the register MOD is "2" (i.e. whether the mode is the transpose mode). If the result of this judgment is negative, (N), processing returns to the routine of FIG. 5.

In case the result of judgment in Step 80 is affirmative, (Y), processing moves to Step 82, wherein judgment is made whether the "+1" or "−1" of the switch INS is turned on. If the result of this judgment is negative, (N), processing returns to the routine of FIG. 5.

In case the result of judgment in Step 82 is affirmative, (Y), processing moves to Step 84, wherein the value of the register TRANS is altered. That is, in case the switch "+1" is turned on, a numerical value which is obtained by adding "1" to the value stored in the register TRANS is set in the register TRANS, and when the switch "−1" is turned on, a numerical value obtained by subtracting "1" from the value stored in the register TRANS is set in the register TRANS. Due to this processing, an increment or a decrement of the amount to be transposed becomes feasible.

Thereafter, in Step 86, a numerical value obtained by subtracting "36" from the value of the register TRANS (i.e. amount to be transposed) is displayed on the indicator 16. And, processing returns to the routine of FIG. 5.

Curve determining sub-routine (FIG. 8)

FIG. 8 shows the curve determining sub-routine. In Step 90, judgment is made whether the numerical value of the register MOD is "1" and whether the numerical value of the register SUBMD is "0" (i.e. whether the mode is KSC normal mode). If the result of this judgment is negative, (N), processing returns to the routine of FIG. 5.

In case the result of judgment in Step 90 is affirmative, (Y), processing moves to Step 92, wherein judgment is made whether the "L" or "R" of the switches CSS is turned on. If the result of this judgment is affirmative, (Y), processing moves to Step 94, wherein cursor-moving processing is carried out. That, if "L" of the switches CSS has been turned on, the cursor CS is moved toward the left on the display face of the indicator 16, whereas in case "R" of the switches CSS has been turned on, the cursor CS is moved toward the right on the display face thereof. Thereafter, processing returns to the routine of FIG. 5.

In case the result of judgment in Step 92 is negative, (N), processing moves onto Step 96, wherein judgment is made whether the switch "+1" or "−1" of the switches INS is turned on. If the result of this judgment is negative, (N), processing returns to the routine of FIG. 5.

In case the result of judgment in Step 96 is affirmative, (Y), processing moves to Step 98, wherein the data value of the item such as "RD" which is indicated by the cursor CS is rendered to "−1" or "+1" in accordance with the switch state which has been turned on as mentioned just above, and correspondingly thereto, the indication itself also is altered. For instance, let us now assume that, when the cursor CS is indicating "RD" as shown in FIG. 2A, the switch "+1" is turned on, whereupon the numerical value of the register RDPTH is incremented by "+1". In compliance therewith, the indicated numerical value "23" is altered to "24". In the same way, with respect to the other items: "LD", "LC", "RC" and "BP" also, it is possible to change their respective numerical values of their corresponding registers LDPTH, DDVSEL, RCVSEL, and BRKPNT. Following the alteration of the numerical values of the respective registers, the indication signals provided below the items corresponding to these respective values are altered also.

When the processing in Step 98 has ended, processing advances to the processing of loading data onto the key scaling registers in Step 100 onwards.

In Step 100, the control variable is assumed to be "i", and "0" is set. With this, processing moves to Step 102, wherein a numerical value obtained by subtracting the value of the register BRKPNT from "i" (i.e. data indicative of the distance up to the break point BP) is set in the register LEN.

Next, in Step 104, judgment is made whether the numerical value of the register LEN is greater than "0" (i.e. whether the position is on the righthand side of the break point BP). As an example, as shown in FIG. 2A, let us assume that, as the "BP", $C\#_4$ is indicated. Then, the numerical value of the register BRKPNT is "21". In this state, when, after setting "i"="0", processing has arrived for the first time at Step 104, the result of said judgment becomes negative, (N), so that processing moves to Step 106.

In Step 106, judgment is made whether the value of the register LCVSEL is "0" or "2" (i.e. whether a curve of a positive gradient). Let us here assume that, in the register LCVSEL, there is set "0" in compliance with "LC"="+L" shown in FIG. 2A. Then, the result of judgment made in Step 106 becomes affirmative, (Y), and processing moves to Step 108. In this Step 108, the numerical value of the register LEN is set, as it is, in the register LN.

In case the result of judgment in Step 106 is negative, (N), this means that the numerical value of the register LCVSEL has been either "1" or "3" (i.e. a curve of a negative gradient), so that processing moves to Step 110. In this Step 110, the value of the register LEN is set in the register LN by inverting the sign of this value. This is for the purpose of making it possible to obtain either a curve "−LIN" or "−EXP" having a negative curve, by reading out level data from the "plus" side toward the break point BP on the horizontal axis of FIG. 4.

In case the processing in either Step 108 or Step 110 has ended, processing moves to Step 112, wherein judgment is made whether the numerical value of the register LCVSEL is "0" or "1" (i.e. whether a rectilinear curve). If the result of this judgment is affirmative, (Y), processing moves to Step 114, wherein the level data corresponding to the numerical value of the register LN (i.e. note group number) is read out from the first functional table LINTBL, and it is set in the register KSCB.

Also, in case the result of judgment in Step 112 is negative, (N), this means that an exponential curve has been selected, so that processing moves to Step 116. In this Step 116, the level data corresponding to the numerical value of the register LN is read out from the second functional table EXPTBL, and it is loaded on the register KSCB.

When the processing in Step 114 or 116 has completed, processing moves to Step 118, wherein judgment is made whether the numerical value of the register LEN is greater than "0", in a manner similar to that in Step 104 described above. When processing has arrived to Step 118 for the first time after having set "i" to "0", the result of judgment in this Step becomes negative, (N), and processing moves to Step 120.

In Step 120, the numerical value obtained by multiplying the value of the register KSCB with the value of the register LDPTH is set in the "i"-th key scaling register $KEYSC_i$. For example, when "i"="0", the result of multiplication is set in the register $KEYSC_0$.

Thereafter, the numerical value of "i" is upped by "1" in Step 122, and thereafter judgment is made in Step 124 as to whether "i" is greater than "39" (i.e. whether processing for the entire key groups is over). When processing has arrived at Step 124 for the first time after "i" has been rendered to "0", "i"="1", so that the result of judgment in Step 124 is negative, (N), so the processing returns to Step 102. And, the above-described series of processing are repeated until the result of judgment in Step 104 becomes affirmative, (Y).

As a result, when the key group (note group) number corresponding to the break point BP is not assumed to be "21" as stated above, the key scaling registers $KEYSC_0 \sim KEYSC_{21}$ are loaded with level data complying with the curve (e.g. "+LIN") with has been selected on the lefthand side of BP, after the level data is amended in accordance with the numerical value of the lefthand side depth register LDPTH. In other words, the gradient of the curve which has been selected on the lefthand side of BP can be modified by appropriately setting the value of the register LDPTH.

When the result of judgment in Step 104 becomes affirmative, (Y), processing moves to Step 126. In this Step 126, judgment is made whether the numerical value of the register RCVSEL is "0" or "2" (i.e. whether a curve of a positive gradient). Let us here assume that the register RCVSEL has been loaded with "3" in compliance with "RC"="−E" shown in FIG. 2A. Then, the result of judgment in Step 28 becomes negative, (N), and processing moves to Step 130. In this Step 130, in a manner similar to that in Step 110 described above, the numerical value of the register LEN is set in the register LN after inverting the sign of the value. This is for the purpose of making it possible to obtain a curve of a negative gradient by reading out the level data from BP of the horizontal axis of FIG. 4 in the direction toward the right side thereof.

Also, when the result of judgment in Step 126 is affirmative, (Y), processing moves to Step 128, wherein, in a manner similar to that in Step 108 described earlier, the value of the register LEN is set, as it is, in the register LN.

Upon completion of the processing in Step 128 or Step 130, processing moves to Step 132, wherein judgment is made whether the numerical value of the register RCVSEL is "0" or "1" (i.e. whether a rectilinear curve). If the result of this judgment is affirmative, (Y), processing moves to Step 114, wherein, in a manner similar to that described above, the level data corresponding to the numerical value of the register LN is read out from the first functional table LINTBL, and it is loaded on the register KSCB.

Also, when the result of judgment in Step 132 is negative, (N), processing moves to Step 116, wherein, in a manner similar to that described above, the level data corresponding to the numerical value of the register LN is read out from the second functional table EXPTBL, and it is written in the register KSCB.

When the processing in Step 114 or Step 116 has completed, processing moves to Step 118, wherein, in a manner similar to that described above, judgment is made whether the value of the register LEN is greater than "0". Since the result of judgment in Step 104 has been affirmative, (Y), the result of judgment in Step 118 also becomes affirmative, (Y), and processing moves to Step 134.

In Step 134, the numerical value obtained by multiplying the value of the register KSCB with the value of the register BDPTH is set in the register $KEYSC_1$. For example, if "i"="22", the result of multiplication is set in the register $KEYSC_{22}$.

Thereafter, in Step 122, the value of "i" is upped by one (1), and thereafter judgment is made in Step 124 as to whether "i">"39". If the result is "i"="22" as in the above-mentioned case, "i" will become "23" in Step 122, and the result of judgment in Step 124 becomes negative, (N). As a result, in this instance, processing returns to Step 102, wherein a series of processing as described above are repeated until "i">"39" is obtained.

As a result, in case the key group (note group) number corresponding to the break point BP is "21", the registers $KEYSC_{22} \sim KEYSC_{39}$ are loaded with the level data complying with the curve (e.g. "−EXP") which has been selected on the righthand side of the break point BP is set after being amended in accordance with the value of the register RDPTH. In other words, the gradient of the curve having been selected on the righthand side of the break point BP can be amended by appropriately setting the value of the register RDPTH.

When "i">"39" is attained, the result of judgment in Step 124 becomes affirmative, (Y), and processing returns to the routine of FIG. 5.

According to the processing of the above-described FIG. 8, it is possible to obtain a desired key scaling curve by the following procedure, i.e. determining the break point BP corresponding to an arbitrary note (key) group; selecting an arbitrary curve from among "+LIN", "−LIN", "+EXP" and "−EXP" on the righthand side and/or the lefthand side of the thus determined break point BP; and an arbitrary gradient is set on the righthand side and/or the lefthand side of the break point BP.

Level value setting sub-routine (FIG. 9)

FIG. 9 shows the level value setting sub-routine. In Step 140, judgment is made whether the value of the register MOD is "1" and whether the value of the register SUBMD is "1" (i.e. whether the mode is KSC fractional mode). If the result of this judgment is negative, (N), processing returns to the routine of FIG. 5.

In case the result of judgment in Step 140 is affirmative, (Y), processing moves to Step 142, wherein judgment is made whether the switch L or R is turned on. If the result of this judgment is affirmative, (Y), processing moves to Step 144.

In Step 144, judgment is made whether a key depression has taken place on the keyboard. If the result of this judgment is negative, (N), processing moves to Step 148, wherein the numerical value of the register $GRP_2$ is altered in compliance with the switch L or R. That is, in case the switch L has been turned on, the value obtained by subtracting "1" from the value of the register $GRP_2$ is set in the register $GRP_2$, whereas when the switch R is turned on, the value obtained by adding "1" to the value of the register $GRP_2$ is set in the register $GRP_2$. With this, processing moves to Step 148.

In Step 148, key (note) name level value indications for three (3) note groups is carried out by the indicator 16. That is, on the lefthand side of the indicator, there are displayed the key (note) name corresponding to the note group number which is less by "1" than the value of the register $GRP_2$ and its level value, whereas in the center are indicated the note name corresponding to the note group number of the value of the register $GRP_2$, and on the righthand side are displayed the note name corresponding to the note group number which is greater by "1" than the value of the register $GRP_2$ and its level value. In this case, the respective key (note) names which are indicated should be understood to represent the note groups, respectively, to which they belong. Also, the respective level values which are indicated are those which are read out from the key scaling registers KEYSC of the corresponding key group numbers.

As an example, if the value of the register $GRP_2$ is "18", there are displayed, on the indicator 16, note names $C\#_3$, $E_3$ and $G_3$ which correspond to the note group numbers "17", "18" and "19", respectively, as shown in FIG. 2B. Below these note names are indicated the level values of the registers $KEYSC_{17}$, $KEYSC_{18}$ and $KEYSC_{19}$, respectively. And, when for example the switch R is turned on, this will increment the value of the register $GRP_2$ by "1", so that there are displayed, on the indicator 16, the note names for the note group numbers "18", "19" and "20" and their level values. At such time, the cursor CS points to the note name "$G_3$" which is displayed in the center. Also, in case the switch L is turned on, the indications are shifted in the direction opposite to that noted in case the switch R is turned on.

When the processing in Step 148 has ended, processing returns to the routine of FIG. 5.

In case the result of judgment in Step 144 is affirmative, (Y), processing moves to Step 150. In this Step 150, by giving reference to the register KC wherein the key code corresponding to the latest-detected actuated key has been stored, the key group (note group) number corresponding to said key code is read out from the conversion table KGCNV, and same is loaded on the register $GRP_2$. Here, the terms "latest-detected actuated key" means the key whose "key-on" state is detected latest on scanning the keys of the keyboard. In the case of a single key which has been depressed, this specific key applies, whereas in the case where a plurality of keys have been depressed, the specific key whose key-on detection is performed latest of these plural keys applies.

Subsequent to Step 150, the processing in Step 148 is carried out in a manner similar to that described above, and thereafter processing returns to the routine of FIG. 5. In case Step 148 is carried out via Step 150 as described above, there are displayed, on the indicator 16, the note names and level values for the three (3) note groups consisting of the note group to which the note of the depressed key belongs, as well as those key (note) groups which flank (on both sides of) the first-mentioned note group. Accordingly, when it is intended to have the indicator display an arbitrary key group (note group) which is located considerably away from the currently displayed note group, it is only necessary to manipulate either the switch L or R, and concurrently to operate the key belonging to the specific note group which is intended to be displayed.

In case the result of judgment in Step 142 is negative, (N), processing moves to Step 152, wherein judgment is made whether the switch "+1" or "−1" is turned on. If the result of this judgment is negative, (N), processing returns to the routine of FIG. 5.

When the result of judgment in Step 152 is negative, (N), processing moves to Step 154. In this Step 154, the level value of the note group pointed to by the cursor is altered, and in this connection the display (indication) is altered also. For example, as shown in FIG. 2B, let us here assume that the cursor CS is pointing to the note group "$E_3$" (note group No. 18). When, in this state, the switch "+1" is turned on, this serves to increment the value of the register $KEYSC_{18}$ by one (1), whereas when the switch "−1" is turned on, the value of the register $KEYSC_{18}$ is decremented by one (1). And, as a result of such an alteration of the numerical value of the register $KEYSC_{18}$, the numerical value which has been freshly set in the register $KEYSC_{18}$ is indicated below "$E_3$.

Subsequent to Step 154, processing returns to the routine of FIG. 5.

According to the above-described processing mentioned in FIG. 9, it should be noted that, by the manipulation of the switch L or R, or by the joint operation of said switch and a key, it is possible to have the level data of an arbitrary key group indicated on the display surface, and also to appropriately set the numerical value of this level data (i.e. level value) by the manipulation of the switch "+1" or "−1".

Modified embodiments

The present invention is not limited to the above-described embodiment, but the invention can be practiced in various modified forms. For example, below-mentioned modifications are feasible.

(1) As the input manipulator knobs, the increment-/decrement switches may be replaced by or used jointly with rotatably knobs, ten keys, etc.

(2) In the above-described embodiment, four (4) kinds of key scaling curves have been prepared in advance. However, any number of key scaling curves can be set. Also, arrangement may be provided so that the preliminarily prepared key scaling curves are not to be used, or no key scaling curve is preliminarily prepared. In such a case, it is only necessary to set "0" or a certain numerical value in all of the registers $KEYSC_0 \sim KEYSC_{39}$ by initializing routine and to determine the contents of the respective registers in accordance with the player's favorite key scaling characteristics.

(3) Arrangement has been provided so that one (1) note group is constituted for every three (3) keys (notes). It is, however, up to the user's will to include how many notes (keys) in a single note group. Apart from the above, arrangement may be provided so that, instead of providing for every note group, musical tone control signal complying with the input operation for each note is stored to thereby determine the musical tone characteristics therefor.

(4) Arrangement has been provided so that the data concerning the key scaling curve which is to be selected is stored in the table memory 24. However, arrangement may be provided so that, each time every key scaling curve is selected, the data concerning thereof is sought by calculation.

(5) The transpose mode may be omitted. In such a case, keys and key codes are so arranged that one key corresponds to one code.

(6) Arrangement has been provided so that the data values of one (1) key group indicated by the cursor can be altered. However, arrangement may be provided so that data values for a plurality of note groups such as three (3) note groups including those note groups located on both sides of the cursor may be altered simultaneously.

(7) The key scaling technique provided by the present invention can be applied not only to the tone volume control, but also to the control of various musical tone elements such as tone color, tone pitch, etc.

What is claimed is:

1. A key scaling apparatus for an electronic musical instrument, comprising:

a keyboard having a plurality of keys representing a plurality of notes, respectively, said notes being sectioned into at least three note groups each consisting of at least one note;

a memory unit having a plurality of memory areas associated with each of said notes or note groups;

manipulator knob means for producing musical tone preparing instruction signals determining characteristics of a musical tone to be produced;

registering means for writing, in said plural memory areas corresponding to a desired note or note group designated by an operated key of the keyboard, the instruction signals produced by the manipulator knob means;

reading-out means for reading out, when a performance mode is designated, from the concerned memory areas corresponding to the note or note group representing said operated key; and control means for controlling, based on the instruction signals supplied from said reading-out means, the characteristics of a musical tone intended to be produced.

2. A key scaling apparatus according to claim 1, further comprising:

transpose amount setting means for setting an amount to be transposed;

transposing means for changing correspondence between said plurality of keys and said plurality of notes in accordance with said amount to be transposed, whereby the note selected by the operated key is transposed for an amount determined by said amount setting means.

3. A key scaling apparatus according to claim 2, in which:

the number of said plural notes can be made greater than the number of said plural keys as a result of setting the amount to be transposed.

4. A key scaling apparatus according to claim 1, wherein:

said musical tone preparing instruction signals include a signal concerning at least one of tone volume, tone color and tone pitch.

5. A key scaling apparatus for an electronic musical instrument, comprising:

a keyboard having a plurality of keys representing a plurality of notes, respectively, said notes being sectioned into at least three note groups each consisting of at least one note;

a memory unit having a plurality of memory areas associated with each of said notes or note groups and storing musical tone control signals, respectively, in accordance with predetermined key scaling characteristics;

manipulator knob means;

indicating means having a displayer;

means for controlling indications of the displayer to indicate the musical tone control signals stored in the memory areas corresponding to a desired note or note group selected by an operated key of the keyboard;

rewriting means for rewriting the musical tone control signals stored in said memory areas corresponding to said desired note or note group in accordance with actuation of said manipulator knobs; and musical tone control means for controlling the characteristics of the musical tone corresponding to said operated key based on the musical tone control signals stored in the memory areas corresponding to a key depressed on said keyboard or a key group to which the depressed key belongs.

6. A key scaling apparatus according to claim 5, wherein:

said musical tone control signals include a signal concerning at least one of tone volume, tone color and tone pitch.

7. A key scaling apparatus for an electronic musical instrument, comprising:

a plurality of notes to be produced, said notes being sectioned into at least three note groups each consisting of at least one note;

operating member means for producing musical tone preparing instruction signals determining the characteristics of a musical tone to be produced;

memory means comprising a plurality of memory areas associated with each of said notes or note groups;

storing means for storing, into each of said memory areas, musical information prepared by an operation of said operating means to determine a characteristic of a musical tone to be produced;

note designating means for designating a desired note among said plurality of notes; and musical tone forming means for forming a musical tone signal having a pitch determined by the designated note, in accordance with the musical information stored in the memory area corresponding to the group to which said designated note belongs, so that said musical tone may be produced on the basis of said musical tone signal.

8. A key scaling apparatus for an electronic musical instrument according to claim 7, further comprising:

keyboard means having a plurality of keys corresponding to said plurality of notes, respectively;

said note designating means designating said note via operation of a corresponding key among said plurality of keys.

9. A key scaling apparatus for an electronic musical instrument according to claim 8, in which:

the number of said plural notes is greater than the number of said plural keys.

10. A key scaling apparatus for an electronic musical instrument according to claim 8, further comprising:

amount designating means for designating an amount to be transposed; and transposing means for changing correspondence between said plurality of keys and said plurality of notes in accordance with said amount to be transposed, whereby the designated note is responsive to said amount to be transposed.

* * * * *

UNITED STATES PATENT AND TRADEMARK OFFICE

CERTIFICATE OF CORRECTION

PATENT NO. : 4,957,032

DATED : September 18, 1990

INVENTOR(S) : Katsuhiko Hirano, et al.

It is certified that error appears in the above-identified patent and that said Letters Patent is hereby corrected as shown below:

On the title page, before "[51]", insert --[30] Foreign Application Priority Data: Nov. 28, 1986 (JP) Japan 61-283,355--.

Signed and Sealed this

Seventeenth Day of March, 1992

*Attest:*

*Attesting Officer*

HARRY F. MANBECK, JR.

*Commissioner of Patents and Trademarks*